US008449142B1

(12) United States Patent
Martin et al.

(10) Patent No.: US 8,449,142 B1
(45) Date of Patent: May 28, 2013

(54) REINFORCED HOUSING STRUCTURE FOR A LIGHTED SIGN OR LIGHTING FIXTURE

(75) Inventors: John D. Martin, Watertown, WI (US); Aaron W. Smith, Watertown, WI (US)

(73) Assignee: C-M Glo, LLC, Watertown, WI (US)

( * ) Notice: Subject to any disclaimer, the term of this patent is extended or adjusted under 35 U.S.C. 154(b) by 240 days.

(21) Appl. No.: 12/904,540

(22) Filed: Oct. 14, 2010

Related U.S. Application Data

(60) Provisional application No. 61/251,496, filed on Oct. 14, 2009.

(51) Int. Cl.
*F21V 1/00* (2006.01)
*F21V 11/00* (2006.01)

(52) U.S. Cl.
USPC ..... 362/240; 362/217.1; 362/246; 362/227; 362/249.01

(58) Field of Classification Search
USPC ..... 362/217.01, 217.02, 217.03, 217.04, 362/217.08, 217.1, 217.11, 217.12, 217.13, 362/217.14, 217.15, 217.16, 217.17, 227, 362/230, 231, 240, 246, 249.01, 249.02
See application file for complete search history.

(56) References Cited

U.S. PATENT DOCUMENTS

| | | | |
|---|---|---|---|
| 818,724 | A | 4/1906 | Williams |
| 1,348,698 | A | 8/1920 | Coulson |
| 1,820,913 | A | 9/1931 | Kelly et al. |
| 1,826,389 | A | 10/1931 | Fullerton |
| 2,058,900 | A | 10/1936 | McDonald |
| 2,173,371 | A | 9/1939 | Penoyer |
| 2,354,367 | A | 7/1944 | Ford |
| 3,208,174 | A | 9/1965 | Wrenshall |
| 3,968,584 | A | 7/1976 | Kingston |
| 4,607,317 | A | 8/1986 | Lin |
| 4,630,180 | A | 12/1986 | Muraki et al. |
| 4,901,207 | A | 2/1990 | Sato et al. |
| 4,941,072 | A | 7/1990 | Yasumoto et al. |
| 4,976,057 | A | 12/1990 | Bianchi |
| 5,027,259 | A | 6/1991 | Chujko |
| 5,032,960 | A | 7/1991 | Katoh |
| 5,057,981 | A | 10/1991 | Bowen et al. |

(Continued)

FOREIGN PATENT DOCUMENTS

| | | |
|---|---|---|
| DE | 29603006 | 4/1996 |
| DE | 29706201 | 7/1997 |

(Continued)

OTHER PUBLICATIONS

Tivoli Industires, Inc., "Electroluminescent Accent and Guide Lighting" product brochure, pp. 1-2.

(Continued)

*Primary Examiner* — Evan Dzierzynski
*Assistant Examiner* — Danielle Allen
(74) *Attorney, Agent, or Firm* — Boyle Fredrickson, S.C.

(57) ABSTRACT

A lighted sign or lighting fixture includes a housing that contains a series of LEDs. The housing has a pair of side walls and a series of spaced apart reinforcing members that extend between and interconnect the side walls. The reinforcing members may be formed integrally with the side walls, or may be in the form of separate members that are securely attached to the side walls. An LED mounting structure, such as a PCB, may be attached to the reinforcing members, or alternatively a separate bottom wall may be secured to the reinforcing members.

14 Claims, 8 Drawing Sheets

U.S. PATENT DOCUMENTS

| | | | |
|---|---|---|---|
| 5,130,761 | A | 7/1992 | Tanaka |
| 5,161,872 | A | 11/1992 | Sasaki et al. |
| 5,295,047 | A | 3/1994 | Windross |
| 5,365,411 | A | 11/1994 | Rycroft et al. |
| 5,526,236 | A | 6/1996 | Burnes et al. |
| 5,539,623 | A | 7/1996 | Gurz et al. |
| 5,567,034 | A | 10/1996 | Dietewich et al. |
| 5,582,480 | A | 12/1996 | Zwick et al. |
| 5,604,480 | A | 2/1997 | Lamparter |
| 5,607,227 | A | 3/1997 | Yasumoto et al. |
| 5,634,287 | A | 6/1997 | Lamparter |
| 5,687,500 | A | 11/1997 | Lamparter |
| 5,729,925 | A | 3/1998 | Prothero |
| 5,812,714 | A | 9/1998 | Hulse |
| 5,954,423 | A | 9/1999 | Logan et al. |
| 5,964,051 | A | 10/1999 | Loeber et al. |
| 5,964,981 | A | 10/1999 | Nelson et al. |
| 6,042,248 | A | 3/2000 | Hannah et al. |
| 6,127,675 | A | 10/2000 | Nakamura et al. |
| 6,146,006 | A | 11/2000 | Cross |
| 6,158,882 | A | 12/2000 | Bischoff, Jr. |
| 6,167,648 | B1 | 1/2001 | Dimmick |
| 6,168,302 | B1 | 1/2001 | Hulse |
| 6,173,517 | B1 | 1/2001 | Eibner et al. |
| 6,193,385 | B1 | 2/2001 | Maki et al. |
| 6,217,201 | B1 | 4/2001 | Hulse |
| 6,244,734 | B1 | 6/2001 | Hulse |
| 6,260,991 | B1 | 7/2001 | Hulse |
| 6,361,186 | B1 | 3/2002 | Slayden |
| 6,366,727 | B1 | 4/2002 | Nojiri et al. |
| 6,481,130 | B1 | 11/2002 | Wu |
| 6,550,952 | B1 | 4/2003 | Hulse et al. |
| 6,557,282 | B1 | 5/2003 | Cleaver |
| 6,582,103 | B1 | 6/2003 | Popovich et al. |
| 6,592,238 | B2 | 7/2003 | Cleaver et al. |
| 6,676,284 | B1 | 1/2004 | Wynne Willson |
| 6,761,472 | B1 | 7/2004 | Cleaver et al. |
| 6,834,979 | B1 | 12/2004 | Cleaver et al. |
| 6,874,924 | B1 | 4/2005 | Hulse et al. |
| 6,896,398 | B2 | 5/2005 | Chambers et al. |
| 6,948,828 | B1 | 9/2005 | Chambers et al. |
| 6,953,262 | B2 | 10/2005 | Cleaver et al. |
| 7,008,097 | B1 | 3/2006 | Hulse |
| 7,011,421 | B2 | 3/2006 | Hulse et al. |
| 7,012,379 | B1 | 3/2006 | Chambers et al. |
| 7,048,413 | B2 | 5/2006 | Fan |
| 7,086,769 | B1 | 8/2006 | Thompson et al. |
| 7,118,251 | B1 | 10/2006 | Chambers et al. |
| 7,178,926 | B2 | 2/2007 | Hulse |
| 7,186,005 | B2 | 3/2007 | Hulse |
| 7,188,970 | B2 | 3/2007 | Cleaver et al. |
| 7,192,161 | B1 | 3/2007 | Cleaver et al. |
| 7,207,692 | B1 | 4/2007 | Hulse |
| 7,229,196 | B2 | 6/2007 | Hulse |
| 7,241,039 | B2 | 7/2007 | Hulse |
| 7,264,366 | B2 | 9/2007 | Hulse |
| 7,264,367 | B2 | 9/2007 | Hulse |
| 7,331,697 | B1 | 2/2008 | Hulse |
| 7,377,787 | B1 | 5/2008 | Eriksson |
| 7,506,997 | B1 | 3/2009 | Eriksson |
| 2004/0062041 | A1* | 4/2004 | Cross et al. ..... 362/240 |
| 2005/0111236 | A1 | 5/2005 | Hulse |
| 2005/0195603 | A1 | 9/2005 | Hulse |
| 2005/0231950 | A1 | 10/2005 | Cleaver et al. |
| 2005/0281024 | A1* | 12/2005 | Mayfield et al. ..... 362/221 |
| 2006/0198119 | A1 | 9/2006 | Hulse |
| 2007/0001613 | A1 | 1/2007 | Hulse |
| 2007/0009210 | A1 | 1/2007 | Hulse |
| 2007/0014096 | A1 | 1/2007 | Hulse |
| 2007/0064409 | A1 | 3/2007 | Hulse |
| 2007/0133204 | A1 | 6/2007 | Hulse et al. |
| 2008/0169746 | A1 | 7/2008 | Hulse |
| 2009/0091915 | A1 | 4/2009 | Eriksson |
| 2009/0091931 | A1 | 4/2009 | Eriksson |

FOREIGN PATENT DOCUMENTS

| | | |
|---|---|---|
| DE | 29803723 | 2/1998 |
| JP | 6-12021 | 1/1984 |
| JP | 62-41185 | 3/1986 |
| JP | 61-165583 | 10/1986 |
| JP | 61-286878 | 12/1986 |
| JP | 3007923 | 12/1994 |
| JP | 2000-29406 | 1/2000 |
| JP | 2000-307152 | 11/2000 |
| JP | 55-97903 | 7/2010 |
| WO | 99/06759 | 2/1999 |
| WO | 99/39319 | 8/1999 |
| WO | 00/14705 | 3/2000 |
| WO | 00/31463 | 6/2000 |
| WO | 02/061328 | 8/2002 |

OTHER PUBLICATIONS

Neo-Neon, "2000 The Light of the Next Millenium" Lighting System Catalog: 1999-2000, Duralight product information pp. 10-21.

Brazilian Patent Office, "Examiner's Technical Opinion", English translation of the most relevant parts of Examiner's Opinion in Brazilian application No. PI0116848-7, Nov. 2009.

* cited by examiner

REINFORCED HOUSING STRUCTURE FOR A LIGHTED SIGN OR LIGHTING FIXTURE

CROSS-REFERENCE TO RELATED APPLICATIONS

This application claims priority to U.S. Provisional Patent Application Ser. No. 61/251,496 filed on Oct. 14, 2009, the entirety of which is hereby incorporated by reference.

BACKGROUND OF THE INVENTION

The present invention relates generally to a sign and particularly to an illuminated sign incorporating a reinforced housing structure.

Signs for storefronts and the like are well known throughout the art. For instance, signs for indicating whether a particular business is open, i.e., "OPEN" signs, and the like are well known. Such signs have traditionally utilized neon for illumination of the sign. In such signs, a number of tubes are arranged to spell out the word or words desired such as, e.g., "OPEN". Such tubes, traditionally glass, are filled with neon, argon, xenon, or other gases, and an electrical charge is applied to the gas by way of a pair of opposed electrodes at either end of the tube to thereby illuminate the gas and the tube. Such signs, however, suffer from a number of disadvantages. Neon tubes tend to be very brittle and susceptible to accidental breakage. In design, a neon sign must have an unobstructed hollow center with one or more ends for applying an electrical charge. The process is thus limited by the constraints of illuminating the tube with neon gas within, and the constraints imposed by the available traditional neon glass tubing which limits the design and appearance of the finished sign and requires a substantially complex fabrication process. Further, neon tubing is relatively expensive and thus replacement of the tubes is undesirable and cost prohibitive.

As such, it has become known to provide signs that simulate the appearance of neon tubing by using a plurality of light emitting members such as, for example, light emitting diodes ("LEDs") arranged along the length of a housing and directed to emit light at a waveguide to thereby illuminate the waveguide in a manner that simulates the appearance of neon. Such constructions are advantageous with respect to traditional neon signs in that the energy needs of these signs are quite small thereby reducing costs to the user. Further, as compared to traditional neon signs, the waveguides and housing may be produced from a relatively lighter weight material other than glass, such as a plastic. However, such signs still suffer from certain disadvantages, in that they may not be as structurally rigid as the frame of a traditional neon sign, thereby allowing bending and other deformations due to forces when they are dropped or pressure is otherwise applied to their surfaces. In addition, manufacturing costs can be reduced by minimizing the material, such as plastic, used to construct the housing or waveguide when compared to current designs. However, the tradeoff is less rigidity and higher susceptibility to deformation or breakage. Thus, it is desired to provide a sign that overcomes each of the foregoing disadvantages while maintaining the high quality illumination provided by the sign.

SUMMARY OF THE INVENTION

The present inventors have recognized that a significant source of material cost for a simulated neon sign is the material used in manufacturing the housing of the sign. Reduction of the amount of material used by reducing the dimensions, including thickness, of the housing can adversely impact structural integrity leading to a product that is easily deformed or otherwise damaged. The addition of reinforcing structures to the housing, however, can simultaneously allow for reduction in material while maintaining or improving structural integrity.

Specifically, the present invention provides a reinforced housing for a lighting arrangement that includes at least one elongated housing having a pair of axially extending sidewalls separated by a space between the sidewalls, and a series of axially spaced apart reinforcing members that extend across the space between the side walls and that are interconnected with the inner facing surfaces of the sidewalls. At least one elongated translucent diffuser is configured for mounting on the elongated housing, and has an inner surface and an outer surface. A series of illumination members, such as light emitting diodes are located within the space between the side walls, and are configured to emit light that strikes the inner surface of the elongated translucent diffuser such that a portion of the light striking the inner surface is diffused and emitted by the outer surface. An electrical power source energizes the light emitting diodes.

The reinforced housing provides structural integrity for the housing and allows light from the LEDs to be emitted. The reinforcing members may be permanently affixed to the inner facing surfaces of the sidewalls, and in one embodiment, may be integrally formed with the housing in order to reduce the complexity and number of parts, and provide for a more sound structure. The LEDs may be supported by an LED support structure, such as a printed circuit board, which may be mounted to one or more reinforcing elements. This arrangement minimizes the materials by providing reinforcing elements that give structural support for the housing and also provide a mount for the LED support structure. The reinforcing members may have an aperture therethrough, and an attachment member may extend through the aperture for engagement with the LED support structure. The housing may include a bottom wall extending substantially the length of the housing, which may be integral to the housing, or alternatively the bottom wall may be mounted to one or more reinforcing elements.

Other aspects, features, and advantages of the invention will become apparent to those skilled in the art from the following detailed description and accompanying drawings. It should be understood, however, that the detailed description and specific examples, while indicating certain embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

An exemplary embodiment of the invention is illustrated in the accompanying drawings in which like reference numerals represent like parts throughout.

In the drawings.

DETAILED DESCRIPTION

Figure 1:
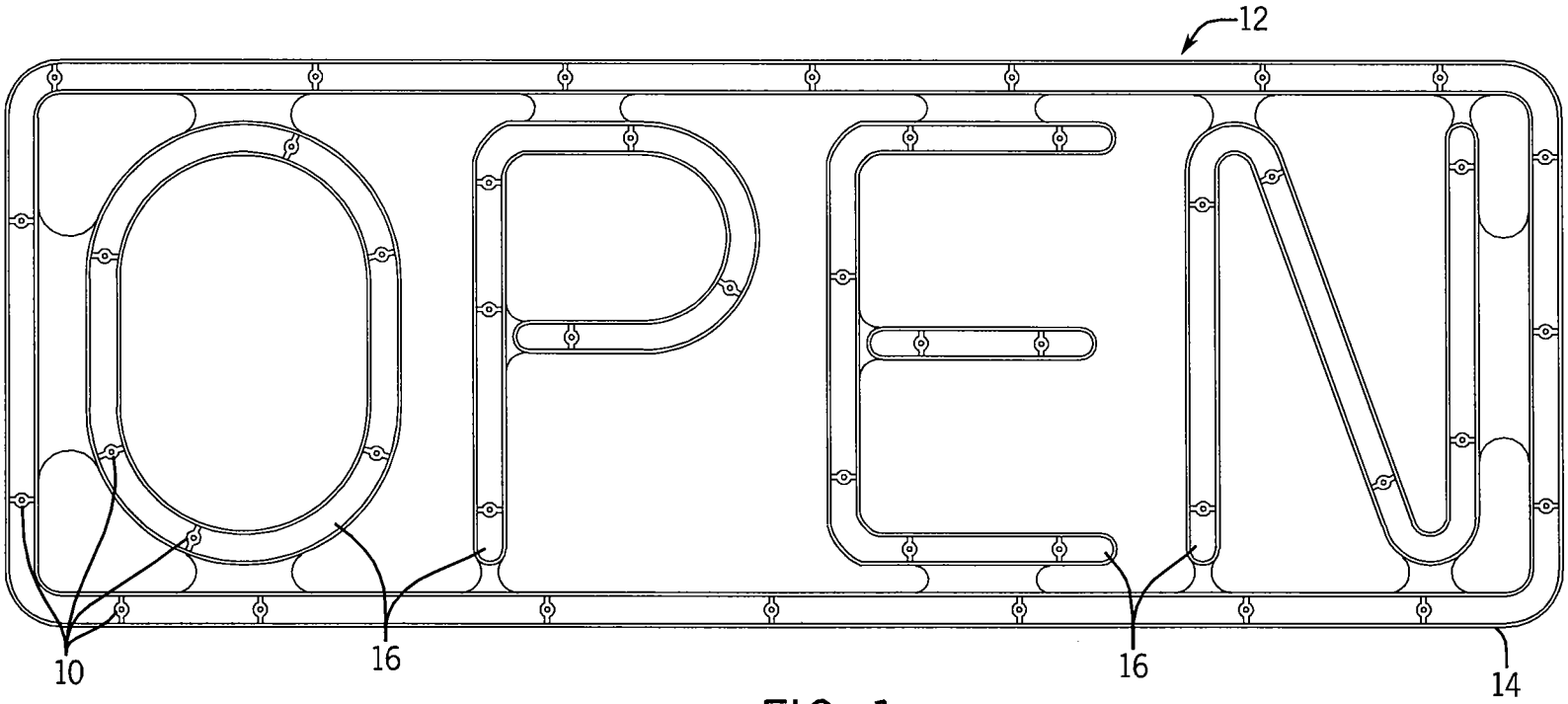
FIG. 1 is a front elevation view of a sign housing according to the present invention.

Referring now to the Figures, and initially to FIG. 1, this invention relates to a housing for a lighting arrangement, such as a simulated neon light housing 12 that includes housing reinforcing structures such as shown at 10. The light housing 12 is adapted to contain a source of light, such as a series of LEDs, along its length in a manner as is known.

A representative embodiment of the present invention is illustrated in FIG. 1 as a sign housing 12 configured as an "OPEN" sign. However, it is understood that housing 12 may be configured in a variety of shapes to display a variety of messages and designs of various colors and sizes as a sign, lighting fixture or otherwise. In this representative embodiment, housing 12 is configured to define simulated neon lights as will be explained below. The simulated neon lights in this embodiment are the quadrilateral border 14 and letters 'O', 'P', 'E', and 'N' 16 as shown in FIG. 1.

Figure 2A:
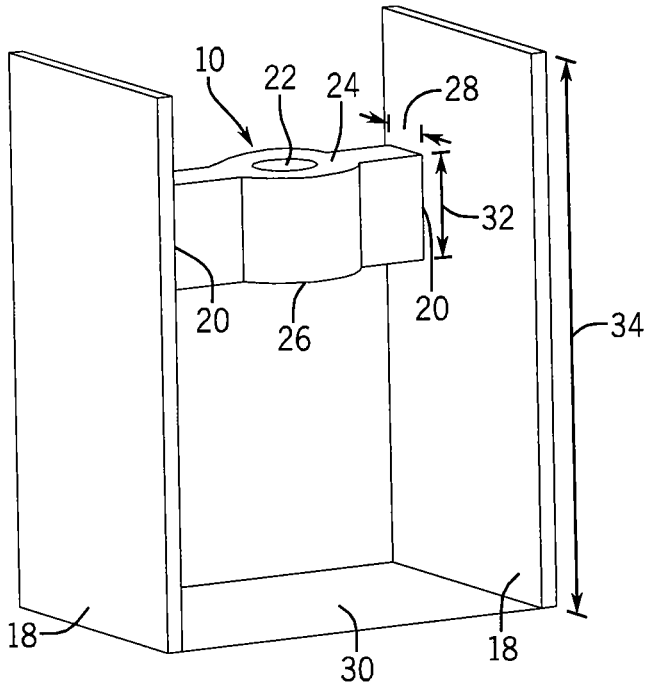
FIG. 2*a* is an enlarged partial isometric view of a portion of the sign housing of FIG. 1 represented by the area shown at numeral 2 in FIG. 1, showing one embodiment of the housing reinforcing structure.
Figure 2B:
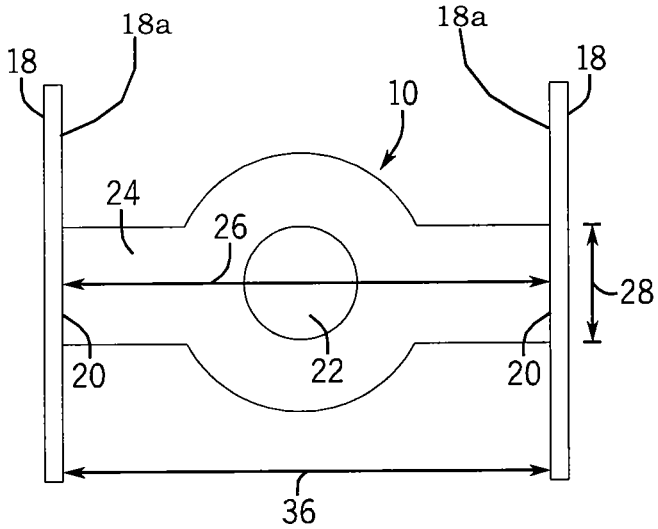
FIG. 2*b* is an enlarged partial front elevation view of a portion of the housing reinforcing structure as shown in FIG. 2*a;*

Referring now to FIGS. 2*a* and 2*b*, the light housing 12 includes a series of spaced apart reinforcing members or structures shown at 10, each of which extends between spaced apart housing side walls 18 having inner facing surfaces 18*a*. Each reinforcing structure 10 defines a pair of ends 20, as shown in FIG. 2*a*, which are secured to or integrated with the housing side walls 18. At the location of each housing reinforcing structure 10, the side walls 18 and the housing reinforcing structure 10 cooperate to define a generally H-shaped cross-section of the light housing 12. The reinforcing structure 10 and the side walls 18 thus cooperate to define a generally open area between the side walls 18, which is destined to define a portion of an interior of a completed sign assembly in a manner as is known.

In one form, each housing reinforcing structure 10 has an upper surface 24 and a lower surface 26. In one embodiment the upper surface 24 and the lower surface 26 are substantially parallel to the housing bottom wall 30 as shown in FIG. 2*a*. The housing reinforcing structure 10 has an end width 28 and an end height 32 that are substantially equal, and which is substantially less than the height 34 of side walls 18. The housing reinforcing structure 10 has a length 36 that is the same as the distance between the inner surfaces of the side walls 18*a* as shown in the top view of FIG. 2*b*.

The housing reinforcing structure 10, in one embodiment, has a mounting structure shown in FIGS. 2*a* and 2*b* as a cylindrical structure with a cylindrical opening 22 extending therethrough. The opening 22 accommodates an attachment with other structures in the housing 12 as will be shown below.

Figure 3:
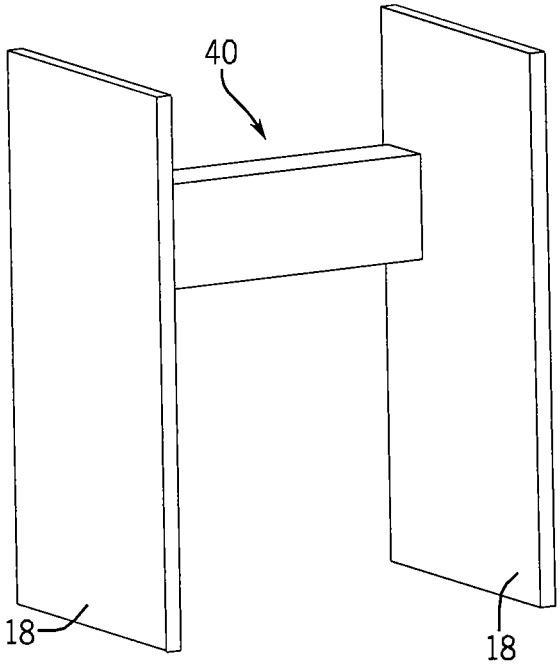
FIG. 3 is an enlarged partial isometric view of a portion of the sign housing of FIG. 1 showing another embodiment of the housing reinforcing structure.

Referring to FIG. 3, in another embodiment, an alternative housing reinforcing structure 40 may be formed without a mounting structure such as 22, such that the housing reinforcing structure 40 is in the shape of a rectangular bar or box that extends between and interconnects the housing side walls 18. Alternatively, other embodiments could be in the form of an elongate cylinder or elongate polygonal structure (not shown).

Housing reinforcing structure 10, 40 may be constructed from an opaque, lightweight and durable material such as plastic. Alternatively, reinforcing structure 10, 40 may be constructed from a relatively lightweight metal such as aluminum or the like through an extrusion, stamping, injection molding, or similar such process. In one embodiment, the reinforcing structures 10, 40 are formed integrally with the sidewalls 18, such as by use of a plastic material in an injection molding process.

Figure 4A:
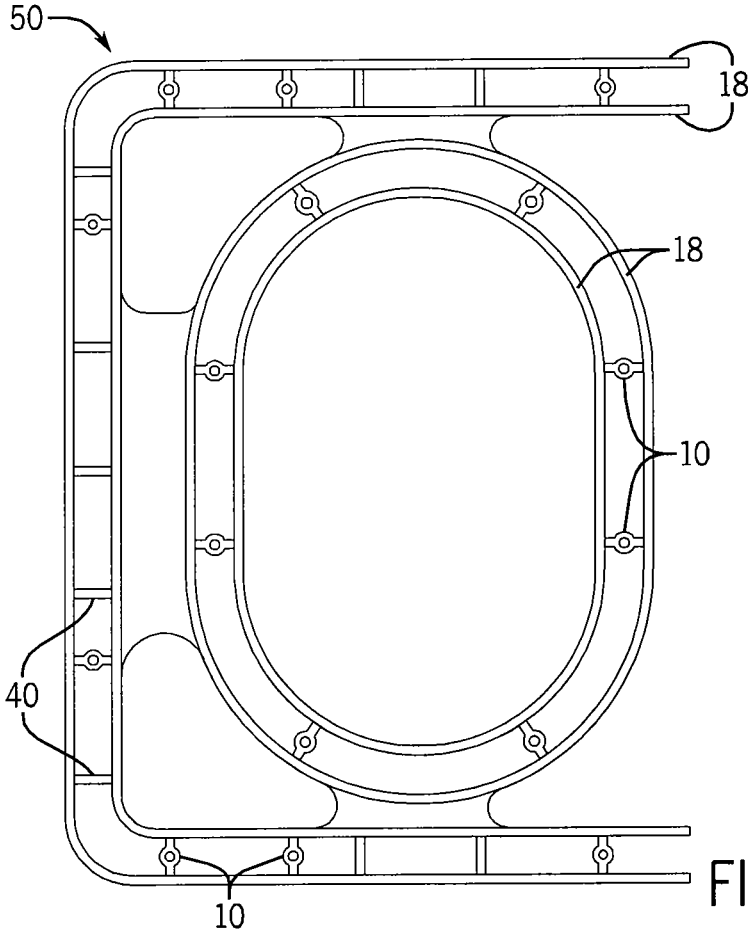
FIG. 4*a* is a partial front elevation view of a portion of the sign housing of FIG. 1 showing the embodiments of the housing reinforcing structures as shown in FIGS. 1-3.
Figure 4B:
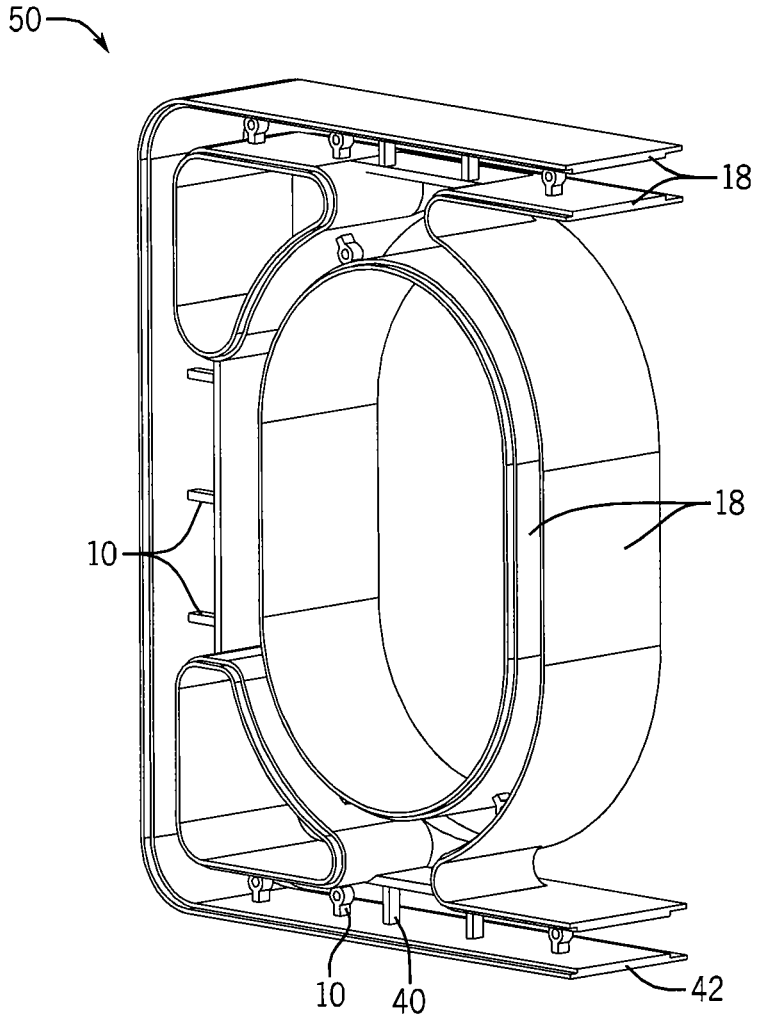
FIG. 4*b* is a partial isometric view of a portion of the sign housing shown in FIG. 4*a;*

Turning now to FIGS. 4*a* and 4*b*, a housing for the letter 'O' 50 incorporated in the light housing 12 is shown having a series of reinforcing structures 10 and 40 at spaced locations, to provide integrity and sufficient mounting points for either the LEDs 72 or the housing bottom wall 30 as will be discussed below. Referring to FIG. 4*b*, in one embodiment, the reinforcing structures 10, 40 are attached about midway along the height, shown at 42, of the side walls 18.

Figure 5A:
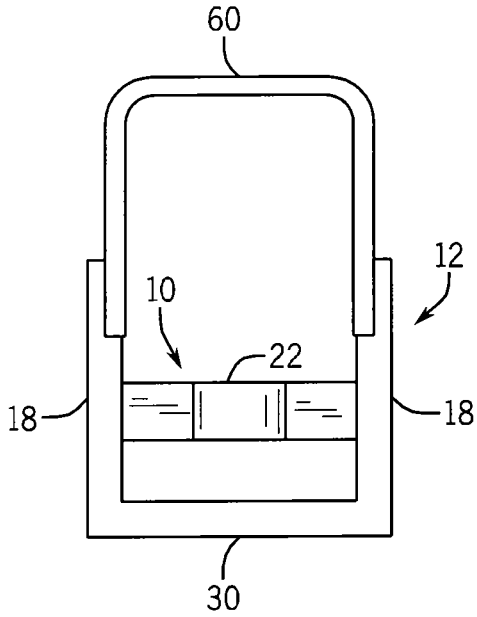
FIG. 5*a* is a section view of the sign housing of FIGS. 1-4*b* with an assembled waveguide and having one embodiment of the housing reinforcing structure.

Referring to FIG. 5*a*, a transverse cross-section of the housing 12 is shown in combination with the bottom wall 30, a diffuser 60, and the housing reinforcing structure 10 with mounting structure 22. The housing reinforcing structure 10 is securable attached to and extends between the side walls 18 at a location above the bottom wall 30.

Figure 5B:
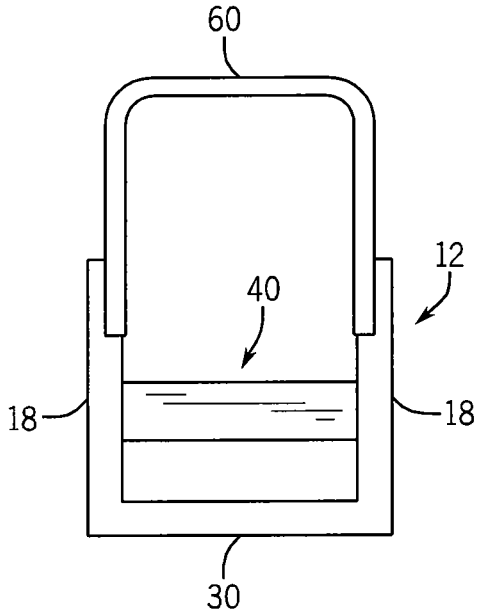
FIG. 5*b* is a section view similar to FIG. 5*a* with an assembled waveguide and another embodiment of the housing reinforcing structure.

Referring to FIG. 5*b*, the housing reinforcing structure 40, which lacks a mounting structure 22, is securable attached to and extends between the side walls 18. In one embodiment, the housing 12 may contain only housing reinforcing structures 40, while in another embodiment, the housing 12 may contain only the housing reinforcing structures 10, and in yet another embodiment the housing 12 may contain a combination of reinforcing structures 10 and 40 as shown in FIGS. 4*a* and 4*b*.

Figure 6A:
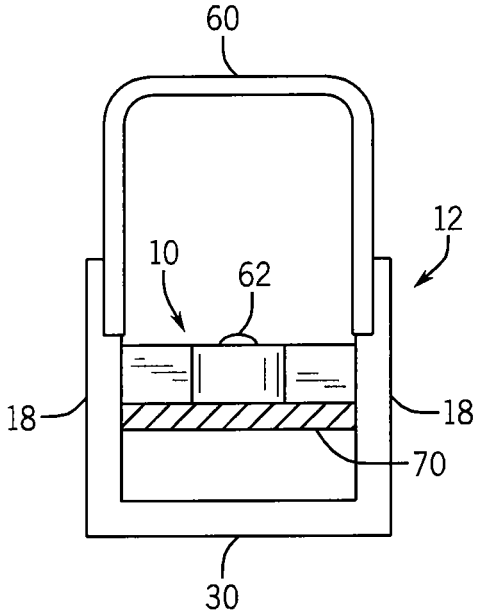
FIG. 6*a* is a section view similar to FIGS. 5*a* and 5*b* with an assembled waveguide and the housing reinforcing structure with an attached LED mounting structure.

Referring now to FIG. 6*a*, in one embodiment the housing bottom wall 30 may be integral with the side walls 18. The housing reinforcing structure 10 may be integral with the housing side walls 18 and the bottom wall 30, or may be formed separately from and attached to the side walls 18.

Figure 6B:
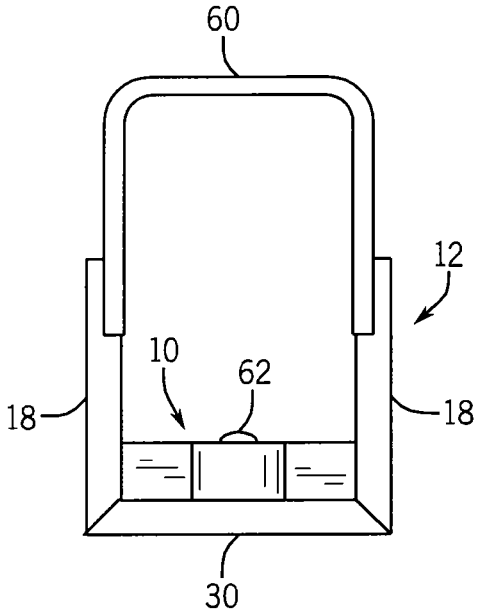
FIG. 6*b* is a section view similar to FIG. 6*a* with an assembled waveguide and a non-integral bottom wall.

Alternatively, the housing bottom wall 30 may be a separate component that is securely attached to the side walls 18 as shown in FIG. 6*b*, such as by use of an adhesive, sonic welding, etc.

In the embodiment of FIG. 6*a*, the housing reinforcing structure 10 may be used to securely attach an LED mounting structure 70, which may be in the form of a PCB as is known, such as by an attachment element 62 in the form of a screw, rivet or the like.

In the embodiment of FIG. 6*b*, the housing reinforcing structure 10 may be used to securely attach to a bottom wall 30, such as by an attachment element 62 in the form of a screw, rivet or the like. In this embodiment, the LED mounting structure may be secured to the bottom wall 30 or may itself form the bottom wall of the housing 12, or alternatively maybe secured within the housing 12 at a location above the reinforcing structure 10. In another embodiment the attachment element 62 may extend upwardly through the housing bottom wall 30 and upwardly into the reinforcing structure 10 (not shown).

In the embodiment of FIG. 6*a*, in which the bottom wall 30 is formed separately from the side walls 18 and the reinforcing structure 10 the reinforcing structure 10 serves primarily to initially hold the side walls 18 together in spaced apart relationship. The connection of the diffuser 60 to the outer ends of the side walls 60 adds rigidity to the assembly. Similarly, the connection of the bottom wall 30 (if used) to the inner ends of the side walls 18 adds additional rigidity to the assembly.

Referring again to FIG. 6*a*, in one embodiment the LED mounting structure 70 is securely attached to the bottom surfaces of reinforcing structures 10 by the attachment elements 62.

Figure 7:
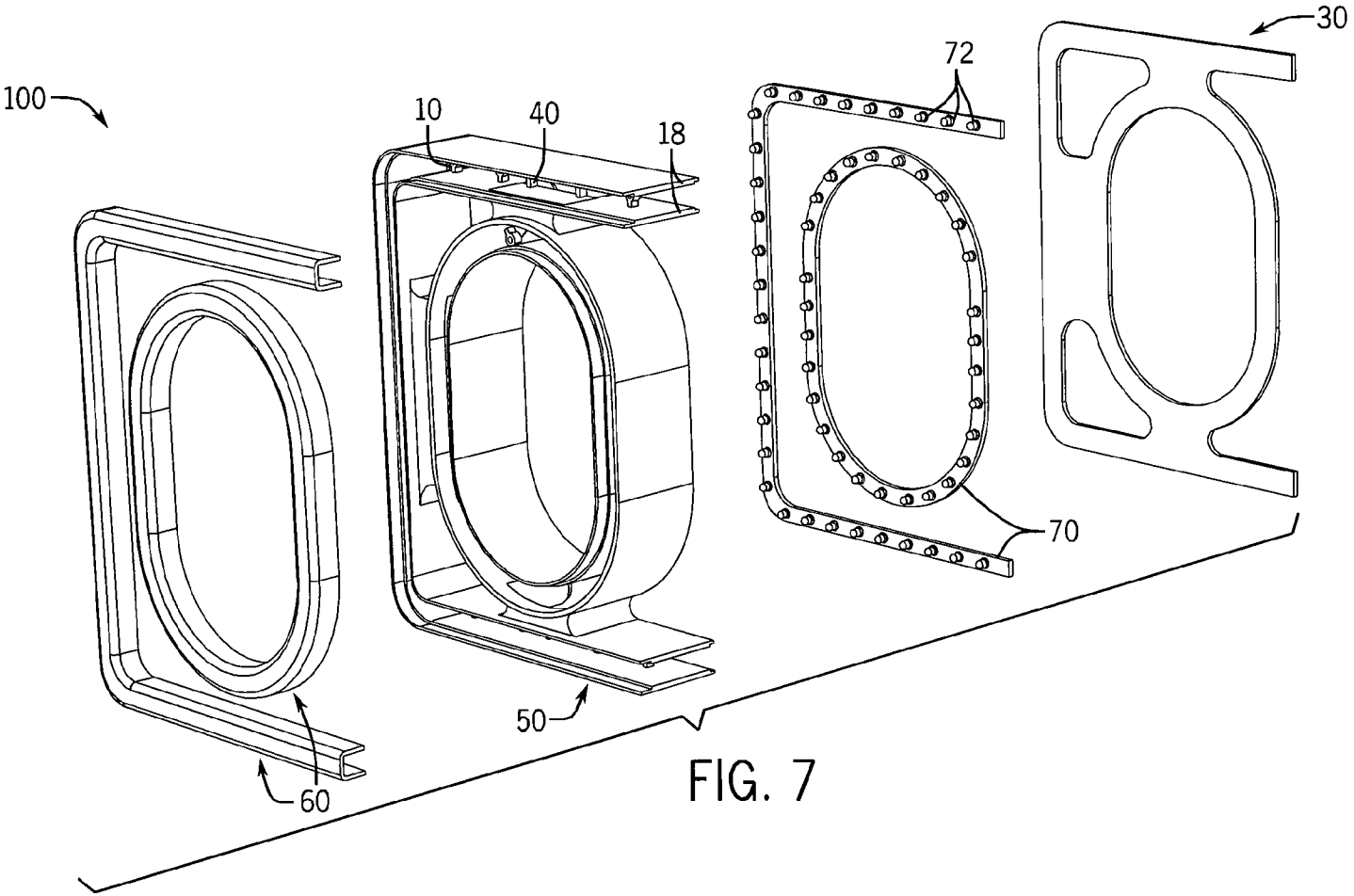
FIG. 7 is an exploded partial isometric view showing the components of a sign incorporating the reinforced housing according to the present invention.

Turning to FIG. 7, an exploded isometric view of a simulated neon light assembly 100 is shown. In this embodiment the light housing 12 set forth above is shaped to define the elements of the light assembly 100, and has reinforcing structures 10, 40 extending between side walls 18. A series of diffusers 60 overlie the open spaces between the sidewalls 18 to diffuse the light emitted by the underlying LEDs that are carried by the LED mounting structure 70. The LED mounting structure 70, in turn, may be in the form of a printed circuit board that carries a series of LEDs 72 along its length, and which is securely attached to the bottom of the reinforcing structures 10, 40 as described above. The housing bottom wall 30 is attached to the bottom of the housing side walls 18 to complete the simulated neon light assembly 100.

Figure 8:
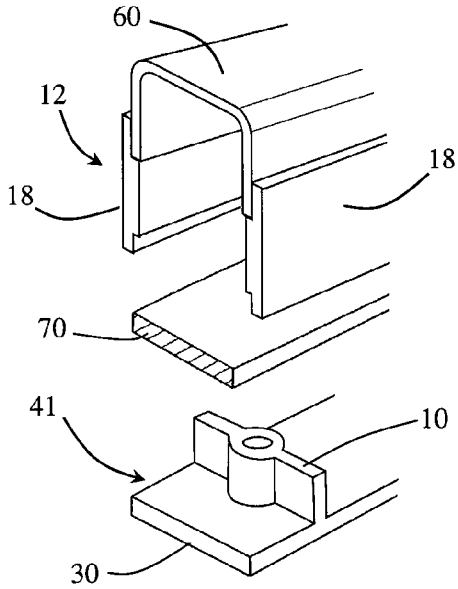
FIG. 8 is an exploded partial isometric view showing the components of a sign incorporating an alternative design of the reinforced housing according to the present invention.

Referring now to FIG. 8, an exploded isometric cross-section view is shown. In this embodiment, an integrated bottom piece 41 includes housing reinforcing structures 10 and bottom wall 30. Integrated bottom piece 41 may be formed as a single element, or housing reinforcing structures 10 may be bonded to bottom wall 30 using adhesives, or by welding, etc. The diffuser 60 is mounted to the upper portions of sidewalls 18 of housing 12. LED mounting structure 70 may be secured to the tops of reinforcing structures 10, or may be secured to the sidewalls 18 above the reinforcing structures 10. The integrated bottom piece 41 may be secured to the lower portions of sidewalls 18 using an adhesive, welding, etc.

Figure 9A:
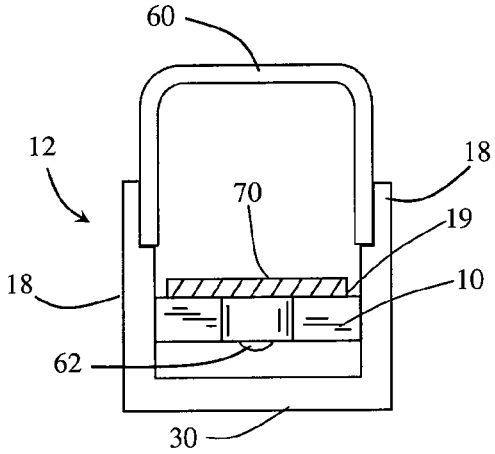
FIG. 9*a* is a section view similar to FIG. 6*a* with an assembled waveguide and the housing reinforcing structure with an LED mounting structure attached to the top of the housing reinforcing structure.
Figure 9B:
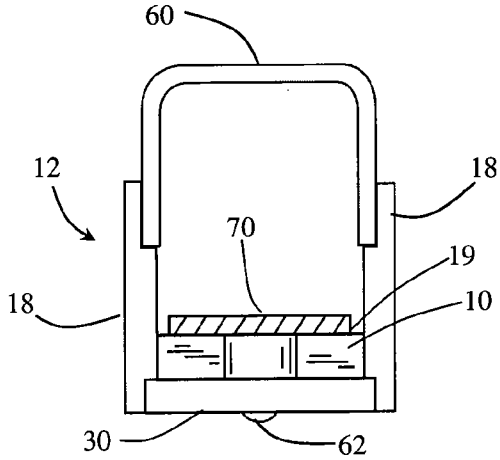
FIG. 9*b* is a section view similar to FIG. 6*b* with an assembled waveguide and a non-integral bottom wall with an LED mounting structure attached to the top of the housing reinforcing structure.

Referring now to FIG. 9*a*, in one embodiment the housing bottom wall 30 may be formed integrally with the side walls 18 of the housing reinforcing structure 12. The housing reinforcing structure 10 may be used to securely attach an LED mounting structure 70, which may be in the form of a PCB as is known, to the housing reinforcing structure top surface 19 such as by an attachment element 62 in the form of a screw, rivet or the like. Alternatively, turning to FIG. 9*b*, the housing bottom wall 30 may be a separate component that is securely attached to the side walls 18, such as by use of an adhesive, sonic welding, etc. The housing reinforcing structure 10 may be used to securely attach to a bottom wall 30, such as by an attachment element 62 in the form of a screw, rivet or the like. In this embodiment, the LED mounting structure 70 may be secured to the housing reinforcing structure top surface 19 above the reinforcing structure 10, either using the attachment elements 62 or any other satisfactory mounting method such as welding, adhesive, etc.

It is understood that, while the invention has been shown and described in connection with the use of LEDs as a light source, any other satisfactory point-type or continuous light emitting arrangement may be employed.

Although the best mode contemplated by the inventor of carrying out the present invention is disclosed above, practice of the present invention is not limited thereto. It is further contemplated that various additions, modifications and rearrangements of the features of the present invention may be made without deviating from the spirit and scope of the invention as set forth in the following claims.

The invention claimed is:

1. A lighted sign, comprising:

a plurality of sign elements that are interconnected with each other and that together form a sign, wherein at least some of the sign elements are separated from each other by open areas therebetween, and wherein one or more of the sign elements are formed by a housing having a pair of sidewalls separated by a space, wherein the sidewalls and the space therebetween cooperate to define a shape of the sign element, and wherein the housing sidewalls are connected together by a plurality of axially spaced apart reinforcing members that extend across the space between the sidewalls and that are interconnected with facing inner facing surfaces defined by the sidewalls, wherein the reinforcing members maintain the space between the sidewalls, and wherein the one or more sign elements further include a translucent diffuser configured for engagement with the sidewalls of the housing over the space between the sidewalls, and a light emitting arrangement located within the space between the side walls, configured to emit light through the diffuser.

2. The lighting arrangement of claim 1 wherein each reinforcing member defines a pair of spaced apart ends that are secured to the inner facing surfaces of the sidewalls.

3. The lighting arrangement of claim 2 wherein the reinforcing members are integrally formed with the side walls.

4. The lighting arrangement of claim 2 wherein the reinforcing members are formed separately from the side walls and are secured to the inner facing surfaces of the sidewalls.

5. The lighting arrangement of claim 1 wherein the light emitting arrangement comprises a series of spaced apart light emitting diodes (LEDs) supported by an LED support structure.

6. The lighting arrangement of claim 5 wherein the LED support structure is mounted to one or more of the reinforcing members.

7. The reinforced housing of claim 6 wherein the LED support structure is a printed circuit board.

8. The lighting arrangement of claim 1 wherein the housing further comprises a bottom wall extending between the side walls.

9. The lighting arrangement of claim 8 wherein the bottom wall is formed integrally with the side walls.

10. The lighting arrangement of claim 8 wherein the bottom wall is formed integrally with one or more reinforcing members.

11. The lighting arrangement of claim 8 wherein the bottom wall is mounted to one or more of the reinforcing members.

12. The lighting arrangement of claim 1 wherein one or more reinforcing members have a mounting structure that supports the light emitting arrangement.

13. The lighting arrangement of claim 12 wherein the mounting structure defines an aperture and wherein the light emitting arrangement is secured to each reinforcing member via at least one attachment element engaged within the aperture.

14. A lighted sign, comprising:

a plurality of sign elements that are interconnected with each other and that together form a sign, wherein at least some of the sign elements are separated from each other by open areas therebetween, and wherein one or more of the sign elements are formed by a housing having a pair of sidewalls separated by a space, wherein the sidewalls and the space therebetween cooperate to define a shape of the sign element, and wherein the housing sidewalls are connected together by a plurality of axially spaced apart reinforcing members that extend across the space between the sidewalls and that are interconnected with facing inner surfaces defined by the sidewalls, wherein the reinforcing members maintain the space between the sidewalls, and wherein the side walls and each reinforcing member cooperate to define an H-shaped cross-section, and wherein the one or more sign elements further include a translucent diffuser configured for engagement with the sidewalls of the housing over the space between the sidewalls, and a light emitting arrangement located within the space between the side walls for emitting light through the diffuser.

* * * * *